United States Patent [19]

Delmege et al.

[11] Patent Number: 4,610,487

[45] Date of Patent: Sep. 9, 1986

[54] DRAWER SLIDE WITH LOCK

[75] Inventors: Dale Delmege, Santa Fe Springs; Richard O. Rask, Whittier, both of Calif.

[73] Assignee: Standard Precision, Inc., Santa Fe Springs, Calif.

[21] Appl. No.: 776,409

[22] Filed: Sep. 16, 1985

[51] Int. Cl.[4] ..... F16C 29/04

[52] U.S. Cl. ..... 384/18

[58] Field of Search ..... 308/3.8, 3.6, 6 R, 3 R; 312/350, 341 R

[56] References Cited

U.S. PATENT DOCUMENTS 4,445,726 5/1984 Röck et al. ..... 308/3.8

4,557,531 12/1985 Röck et al. ..... 308/3.8

4,560,212 12/1985 Papp et al. ..... 308/3.6

4,563,044 1/1986 Rees ..... 308/3.8

*Primary Examiner*—Lenard A. Footland

*Attorney, Agent, or Firm*—Edgar W. Averill, Jr.

[57] ABSTRACT

An improved drawer slide having a deformable brake to hold the slide in any desired degree of extension. The slide is of the type which has an outer slide member with two inwardly-facing ball-bearing supporting grooves, an inner slide member with two outwardly-facing ball-bearing supporting grooves, a brake block is held on the outer slide member and is deformed so that it contacts the inner slide member when it is desired to lock the slide in position.

11 Claims, 9 Drawing Figures

FIG. 4.
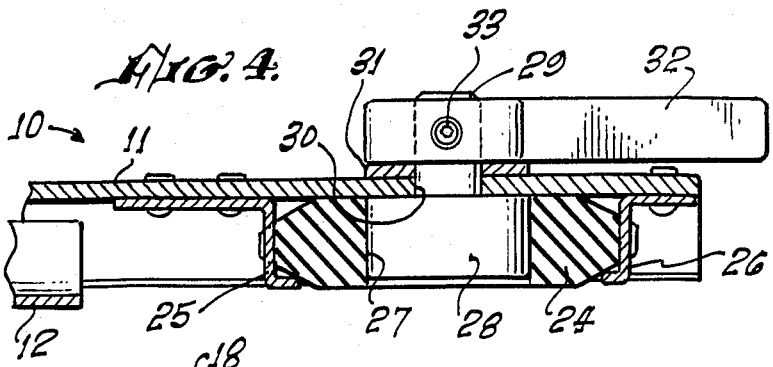
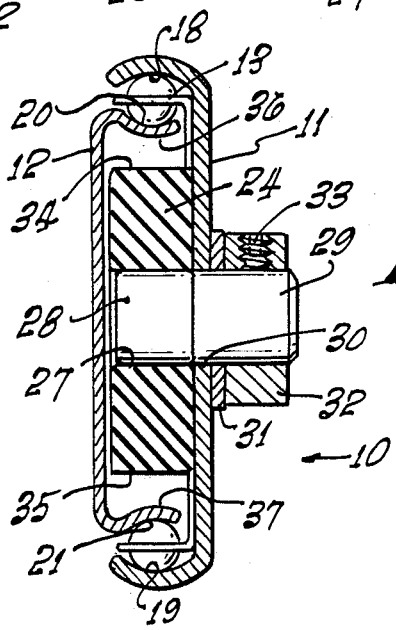
FIG. 5.
FIG. 6.
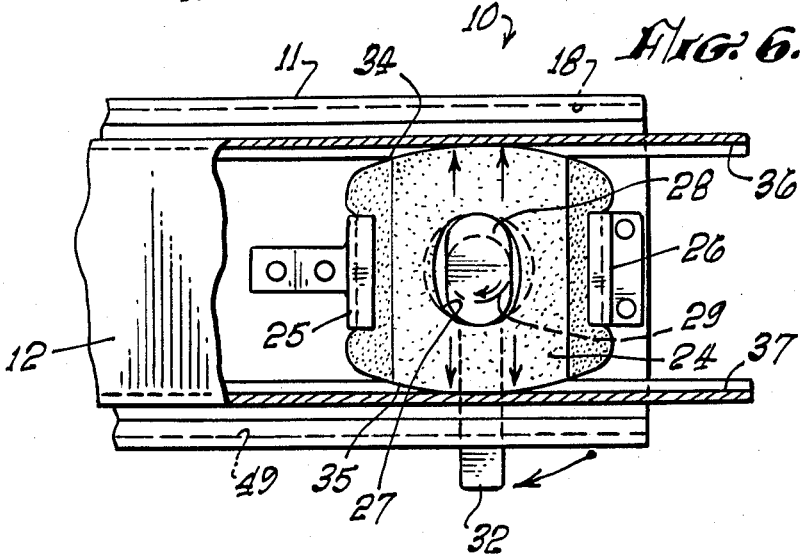

DRAWER SLIDE WITH LOCK

BACKGROUND OF THE INVENTION

The field of the invention is drawer slides and the invention relates more particularly to drawer slides of the type which can be locked in an extended position.

One lockable slide is disclosed in U.S. patent application Ser. No. 540,006 filed Oct. 7, 1983. This slide had a metal latch which cooperated with a metal tab to hold the slide in a locked-out configuration. For many applications, however, it is desired to hold the slide in any locked-out position rather than just in a fully extended position. For instance, when the slide is used to support computer keyboards, it is difficult to design a slide which would fit all key boards, and thus the use of a lock capable of locking the slide in any desired extension could be used with a wide variety of keyboards. Also, for some typing applications, different users prefer the keyboard in a different position.

Another disadvantage of many prior art slide locks is that they tend to rattle. That is, a small amount of longitudinal motion is permitted when the slide is in a locked-out configuration. Such movement and sound can be distracting for applications such as the holding of a computer keyboard. It is thus desirable that a drawer slide be available which is capable of locking in any desired position and also locking the slide in a firm non-rattling manner.

SUMMARY OF THE INVENTION

It is an object of the present invention to provide a drawer slide which may be locked out in any position and which locks out the slide in a secure, non-rattling manner.

The present invention is for an improved drawer slide of the type having an outer slide member, having a longitudinal axis and a pair of inwardly-facing, ball-bearing supporting grooves, an inner slide member positioned within said outer slide member, said inner slide member having a pair of outwardly-facing ball-bearing supporting grooves. A plurality of ball-bearings are held between the pair of grooves on the outer slide member and a pair of grooves on the inner slide member by a ball retainer. The improvement comprises a deformable brake block held on the outer slide member and shaped so that the inner slide member may pass freely over it when it is non-deformed. Means are provided to deform the brake block from its deformed condition to a deformed condition wherein it contacts the inner slide member to hold the inner slide member from moving with respect to the outer slide member.

Preferably the deformation of the brake block is carried out by the turning of a cam within an opening in the brake block. In a preferred configuration, the brake block is generally rectangular and held at its rectangular ends against the outer slide member.

BRIEF DESCRIPTION OF THE DRAWINGS

FIG. 4 is a cross-sectional view taken along line 4—4 of FIG. 2.

FIG. 5 is a cross-sectional view taken along line 5—5 of FIG. 2.

FIG. 6 is an enlarged view of the locking mechanism of the slide of FIG. 1 in the locked position.

DESCRIPTION OF THE PREFERRED EMBODIMENTS

Figures 1, 2, 3:
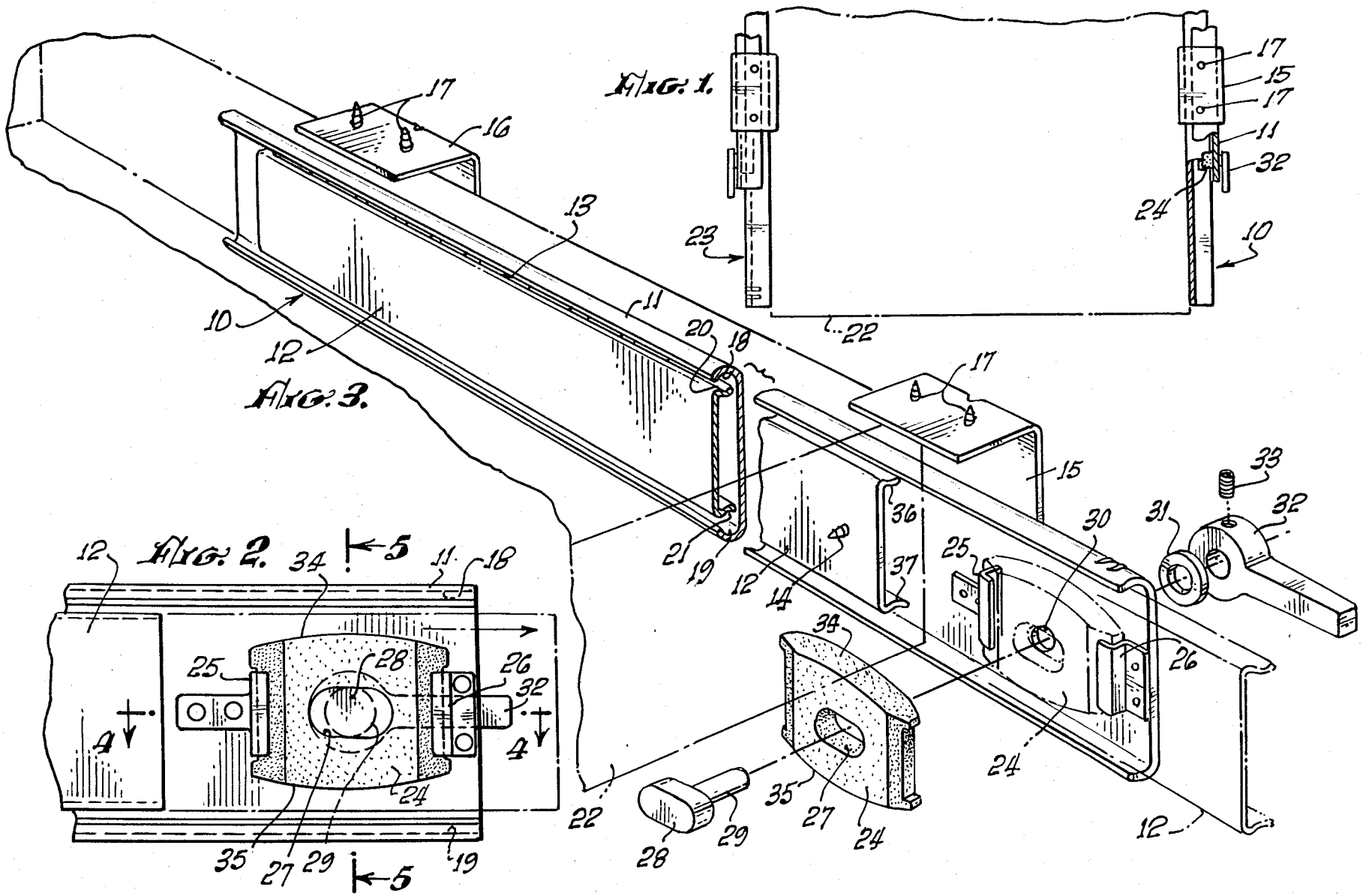
FIG. 1 is a top view of a drawer supported by a pair of lockable drawer slides of the present invention.
FIG. 2 is an enlarged side view of the end of the outer slide member showing the brake block of the present invention in an unlocked configuration.
FIG. 3 is an exploded perspective view of the lockable drawer slide of the present invention.

The drawer slide of the present invention is shown in exploded perspective view in FIG. 3 and indicated generally by reference character 10. Slide 10 has an outer slide member 11, an inner slide member 12, and a ball retainer 13. The inner slide member may be held to a drawer by a pair of screws such as screws 14, and the outer slide member may be held to the underside of a table by a pair of brackets such as brackets 15 and 16, each having two screws 17. Outer slide member 11 has a pair of ball grooves 18 and 19. An inner slide member 12 has a pair of ball grooves 20 and 21. A plurality of ball-bearings, not shown, are held between grooves 18 and 20 and grooves 19 and 21 and positioned by a ball retainer 13 in a conventional manner.

A pair of slides of the present invention are shown in FIG. 1 affixed to a drawer shown in phantom lines and indicated by reference character 22. A second slide 23 is analogous to slide 10 except that it is a mirror image thereof. It is not necessary that both slides be lockable, but an exceptionally firm and rattle-free positioning results when both sides may be locked which is possible when both slides are lockable as shown in FIG. 1.

The operation of the lock of the slide of the present invention occurs when a brake block 24 is deformed. As shown in FIG. 3, brake block 24 is held by a pair of generally "L" shaped brackets 25 and 26 which are affixed to inner slide member 12. Brake block 24 has a generally oval shaped opening 27 in the center thereof. As shown in FIG. 6, the oval opening 27 is deformed by the turning of generally oval cam member 28 which forces the top 34 and the bottom 35 of brake block 24 to contact the underside of ball grooves 20 and 21. The L-shaped brackets 25 and 26 continue to hold the brake block 24 against the inner surface of outer slide member 11. Brake block 24 is fabricated from a deformable material such as an elastomer. A urethane elastomer has proved satisfactory for this purpose.

FIG. 5 shows the position of brake block 24 prior to the turning of handle 32. It can clearly be seen that, in that position of cam member 28, top 34 and bottom 35 of brake block 24 do not touch the underside of grooves 20 and 21, and thus the inner slide is permitted to move freely within the outer slide.

It can also be seen in FIG. 6 that the rubber brake block securely wedges against the inner slide member 12 to securely hold it in a fixed position without permitting any rattling. The vast majority of prior art locks utilize some sort of a pin in an opening which inherently permits a certain amount of rattling. For uses such as a computer keyboard, a secure rattle-free lock is highly beneficial.

Figure 7:
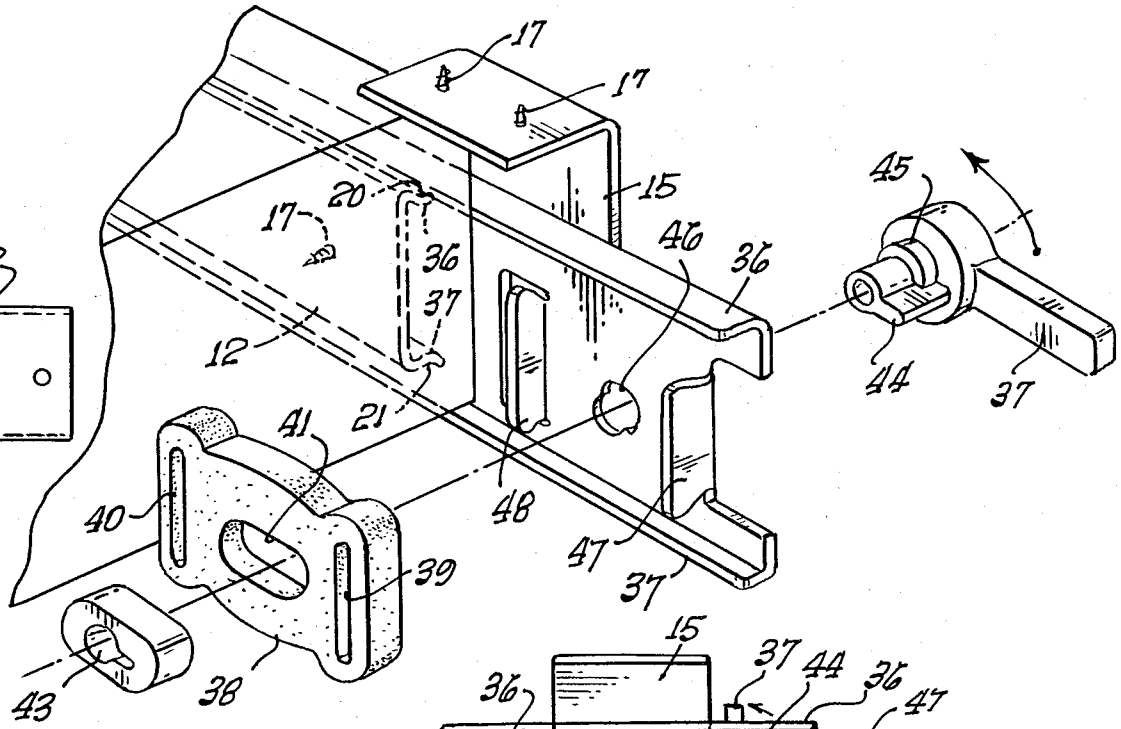
FIG. 7 is an exploded perspective view of a lockable drawer slide having an alternate configuration of brake block.
Figure 9:
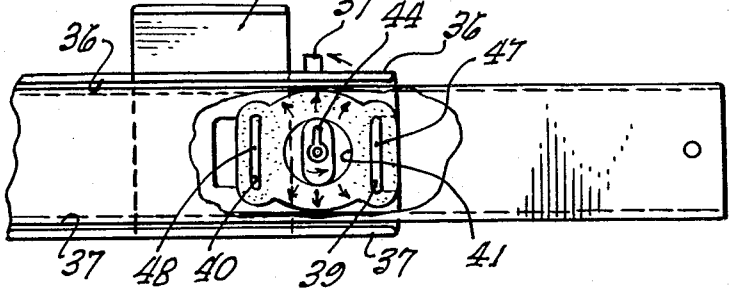
FIG. 9 is a side view partially cut away of the drawer slide of FIG. 7 in a locked configuration.
Figure 8:
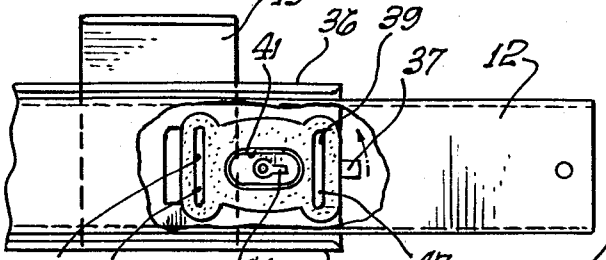
FIG. 8 is a side view partially cut away of the drawer slide of FIG. 7 in an unlocked configuration.

An alternate configuration of block is shown in FIGS. 7 through 9 where inner slide member 12 is held in a conventional manner by outer slide member 36 which, in turn, is affixable to the underside of a table by screws 17 or other means. Brake block 38 has a pair slots 39 and 40 along its longitudinal edges, and an oval opening is formed in the center thereof which holds a generally oval cam member 42 as shown in FIGS. 8 and 9. Cam 42 has a keyed opening 43 which fits the key member 44 in handle 37. Handle 37 has a shoulder 45 which abuts the exterior surface of outer slide member 36 adjacent opening 46. Brake block 38 is held by a pair of tabs 47 and 48, lanced out from outer slide member 36. The assembled configuration is shown in FIG. 8 in an unlocked position. Handle 37 is moved upwardly to a position shown in FIG. 9 where brake block 38 is expanded to contact the undersides 36 and 37 of ball grooves 20 and 21 of inner slide member 12.

Other means to deform the block could be used such as off-centered cam member. An important requirement is that the block be expanded outwardly so that it contacts the inner slide member.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved drawer slide of the type having an outer slide member having a longitudinal axis and a pair of inwardly-facing, ball-bearing supporting grooves, an inner slide member positioned within said outer slide member, said inner slide member having a pair of outwardly-facing, ball-bearing supporting grooves, a plurality of ball bearings held between said pair of grooves on said outer slide member and said pair of grooves on said inner slide member, said ball bearings being positioned by a ball retainer, wherein the improvement comprises:

a deformable brake block held on said outer slide member and shaped so that said inner slide member may pass freely over said block when said brake block is not deformed, said brake block having an opening therein;

a movable cam member held by said outer slide member and positioned within said opening in said brake block, said cam member being shaped so that it does not deform said brake block sufficiently to contact said inner slide member when it is in a first position and so that it deforms said deformable brake block so that it does contact said inner slide member when it is in a second position; and means to move said cam member between said first and second position.

2. The improved drawer slide of claim 1 wherein said brake member is supported at the ends thereof which lie along the longitudinal axis of said outer slide member.

3. Ihe improved drawer slide of claim 1 wherein said brake member is fabricated from a urethane elastomer.

4. The improved drawer slide of claim 1 wherein said brake member is generally rectangular in shape.

5. The improved drawer slide of claim 1 wherein said opening in said brake block is located in the center of the brake block.

6. The improved drawer slide of claim 1 wherein said means to move said cam member comprises a cam handle affixed to said cam member through a shaft.

7. The improved drawer slide of claim 1 wherein said brake block has a generally oval opening therein and said cam is about the same size and shape as said opening.

8. The improved drawer slide of claim 1 wherein said brake block is generally rectangular in shape and is held at the ends thereof which lie along the longitudinal axis of said outer slide member and said brake block has a generally rectangular opening therein and said cam member is generally about the same size and shape as said opening.

9. The improved drawer slide of claim 1 wherein said brake block is located near the exterior end of said outer slide member.

10. An improved drawer slide of the type having an outer slide member having a longitudinal axis and a pair of inwardly-facing ball-bearing supporting grooves, an inner slide member positioned within said outer slide member, said inner slide member having a pair of outwardly-facing ball-bearing supporting grooves, a plurality of ball-bearings held between said pair of grooves on said outer slide member and said pair of grooves on said inner slide member, said ball-bearings being positioned by a ball retainer, wherein the improvement comprises:

a deformable brake block, said brake block being held on said outer slide member and oriented so that said inner slide member may pass freely over said block, said brake block having means for deforming the block associated therewith; and actuating means affixed to said outer slide member and positioned so that it can be operated from the exterior of said outer slide member, said means for deforming the block causing said block to move from a first shape in which shape it does not deform said brake block sufficiently to contact said inner slide member and to move to a second shape so that said brake block contacts said inner slide member.

11. The improved drawer slide of claim 10 wherein said means for deforming comprise cam means.

* * * * *